US010458417B2

(12) United States Patent
Hsiung et al.

(10) Patent No.: US 10,458,417 B2
(45) Date of Patent: Oct. 29, 2019

(54) CENTRIFUGAL FAN WITH AXIAL-FLOW WIND

(75) Inventors: Shih-Kang Hsiung, Taoyuan County (TW); Hung-Chi Chen, Taoyuan County (TW); Meng-Yu Chen, Taoyuan County (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 1146 days.

(21) Appl. No.: 13/603,945

(22) Filed: Sep. 5, 2012

(65) Prior Publication Data

US 2013/0315724 A1 Nov. 28, 2013

(30) Foreign Application Priority Data

May 28, 2012 (TW) ..... 101118927 A

(51) Int. Cl.

| | |
|---|---|
| ***F04D 25/06*** | (2006.01) |
| ***F04D 29/30*** | (2006.01) |
| ***F04D 17/02*** | (2006.01) |
| ***F04D 29/42*** | (2006.01) |
| ***F04D 29/28*** | (2006.01) |

(52) U.S. Cl.

CPC ..... *F04D 25/0613* (2013.01); *F04D 17/025* (2013.01); *F04D 29/281* (2013.01); *F04D 29/30* (2013.01); *F04D 29/4253* (2013.01)

(58) Field of Classification Search

CPC .. F04D 17/025; F04D 29/2205; F04D 29/263; F04D 29/281; F04D 29/30; F04D 29/40; F04D 29/403; F04D 29/42; F04D 29/4226; F04D 29/4233; F04D 29/4253; F04D 29/44; F04D 29/441

See application file for complete search history.

(56) References Cited

U.S. PATENT DOCUMENTS

| | | | | | |
|---|---|---|---|---|---|
| 594,206 | A | * | 11/1897 | Jeffreys | F04D 29/426 415/208.3 |
| 3,829,250 | A | * | 8/1974 | Samson, Jr. | 417/423.1 |
| 4,798,518 | A | * | 1/1989 | Holzberger et al. | 415/208.3 |
| 5,188,508 | A | * | 2/1993 | Scott et al. | 415/206 |

(Continued)

FOREIGN PATENT DOCUMENTS

| | | |
|---|---|---|
| CN | 2115419 | 9/1992 |
| CN | 201339600 | 11/2009 |
| CN | 101660535 | 3/2010 |

OTHER PUBLICATIONS

Office Action dated Aug. 4, 2014 from corresponding No. TW 101118927.

(Continued)

*Primary Examiner* — Dwayne J White
*Assistant Examiner* — Jason G Davis
(74) *Attorney, Agent, or Firm* — Hauptman Ham, LLP

(57) ABSTRACT

A centrifugal fan with axial-flow wind includes a centrifugal fan wheel and a cover shell. The centrifugal fan wheel has a rotating core structure and a plurality of centrifugal vanes arranged around the rotating core structure; a circular wind guide surface is disposed on an internal side of the cover shell and around the rotating core structure and covered onto the centrifugal vanes, such that the circular wind guide surface can change a centrifugal airflow at the external periphery of the centrifugal vane into an axial-flow airflow.

8 Claims, 11 Drawing Sheets

(56) References Cited

U.S. PATENT DOCUMENTS

| | | | | |
|---|---|---|---|---|
| 6,210,118 | B1 * | 4/2001 | Egawa | F04D 29/281 416/243 |
| 6,425,739 | B1 * | 7/2002 | Ambler | 415/208.3 |
| 2002/0106277 | A1 * | 8/2002 | Chapman | 415/206 |
| 2004/0240999 | A1 * | 12/2004 | Kamoshita et al. | 416/179 |
| 2009/0263232 | A1 * | 10/2009 | Jarrah | F04D 25/0613 415/4.4 |
| 2012/0070277 | A1 * | 3/2012 | Chen | F04D 25/08 415/224 |

OTHER PUBLICATIONS

Office Action dated Apr. 3, 2015 from corresponding No. CN 201210168823.6.

* cited by examiner

CENTRIFUGAL FAN WITH AXIAL-FLOW WIND

FIELD OF THE INVENTION

The present invention relates to a centrifugal fan, in particular to the centrifugal fan with axial-flow wind centrifugal fan.

BACKGROUND OF THE INVENTION

Fan is a common device for heat transfer engineering, and fans with a flow channel are mainly divided into two types, respectively: a centrifugal fan and an axial-flow fan. In the centrifugal fan, air enters from an axial direction of a fan wheel and the fan blows air out in a direction tangential to the rotation of the centrifugal fan. In the axial-flow fan, air enters and the fan blows air from the axial direction of the fan wheel. In the comparison of flow fields of the forgoing two types of fans, the flow field of the centrifugal fan has a greater static pressure and a smaller flow, and the flow field of the axial-flow fan has a smaller static pressure and a greater flow.

Different types of fans are provided to fit the installation requirements with different spaces. For example, the installation of the centrifugal fan is suitable for electronic devices with a small, narrow and flat space, and the installation of the axial-flow fan is suitable for computer chassis with sufficient installation space and having a larger quantity of generated heat than that of the mobile electronic devices.

With reference to FIGS. 1 and 2, a housing 10 of an automobile electronic device is suitable for installing an axial-feed-axial-exit axial-flow channel and applicable for the axial-flow fan. The rotating area of vanes 21 of the axial-flow fan 20 is equal to the cross-sectional area of the flow channel. If electronic devices are installed in this range, the airflow will be hindered, and thus electronic devices installed in the housing 10 are preferably installed at the positions of a fan hub 22 situated at the center of the axial-flow fan 20. However, the fan hub 22 of the axial-flow fan 20 generally comes with a small volume, and the space for installing the electronic devices in the housing 10 is limited. To optimize the operation of a flow channel, it is necessary to install a larger axial-flow fan 20 to obtain a greater area of the fan hub 22. For the axial-flow fan 20 of a regular size, the flow channel may be hindered by the electronic devices.

SUMMARY OF THE INVENTION

Therefore, it is a primary objective of the present invention to provide a centrifugal fan with axial-flow wind, wherein airflow is guided by a cover shell, so that air is fed in an axial direction of the centrifugal fan and exited from the axial direction of the centrifugal fan and along the external periphery of the centrifugal fan wheel.

To achieve the aforementioned objective, the present invention provides a centrifugal fan with axial-flow wind comprising a centrifugal fan wheel, a cover shell and a fixed base. The centrifugal fan wheel has a rotating core structure and a plurality of centrifugal vanes arranged around the rotating core structure. The cover shell is substantially like a conical shape or a cylindrical shape and covered onto the exterior of the centrifugal fan wheel. The cover shell has a circular wind guide surface disposed on an internal side of the cover shell, and a surface of the circular wind guide surface disposed around the rotating core structure and covered onto the centrifugal vanes, and a wind inlet is formed at the top of the cover shell. The centrifugal fan wheel is installed on the fixed base.

Preferably, the rotating core structure comprises a fan hub and a bottom plate, and the bottom plate is extended in a radial direction from the fan hub, and the centrifugal vanes are installed on the bottom plate.

Preferably, each of the centrifugal vanes has a distal end bent towards a forward direction of the centrifugal fan wheel.

Preferably, the centrifugal fan with axial-flow wind further comprises a wind outlet formed between the cover shell and the fixed base and arranged substantially parallel to an opening of the wind inlet.

Preferably, the fixed base includes a shaft sleeve vertically disposed thereon for sheathing the rotating core structure, and the centrifugal fan wheel is coupled to the fixed base by the rotating core structure.

To achieve the aforementioned objective, the present invention further provides a centrifugal fan with axial-flow wind, comprising a centrifugal fan wheel and a cover shell. The centrifugal fan wheel has a fan hub, a bottom plate and a plurality of centrifugal vanes arranged around the rotating core structure. The cover shell is covered onto the exterior of the centrifugal fan wheel, and has a circular wind guide surface disposed on an internal side of the cover shell, and the circular wind guide surface is disposed around the rotating core structure and covered onto the centrifugal vanes, and the cover shell has a wind inlet formed at the top of the cover shell, wherein each of the centrifugal vanes has a distal end extended beyond the bottom plate and bent towards a forward direction of the centrifugal fan wheel.

Preferably, the centrifugal fan with axial-flow wind further comprises a fixed base coupled to the centrifugal fan wheel.

Preferably, the fixed base includes a shaft sleeve vertically disposed thereon for sheathing the fan hub, and the centrifugal fan wheel is coupled to the fixed base by the fan hub.

Preferably, the cover shell is substantially like a conical shape or a cylindrical shape, and a wind outlet is formed between the bottom of the cover shell and the fixed base.

Preferably, the wind outlet of the centrifugal fan with axial-flow wind is substantially parallel to an opening of the wind inlet.

In the centrifugal fan with axial-flow wind of the present invention, the circular wind guide surface and the bent distal end of the centrifugal vane guides the airflow at the external periphery of the centrifugal fan wheel to flow from the centrifugal direction to the axial-flow direction. When the centrifugal fan is installed into the housing, more spaces inside the housing are available for installing the electronic devices.

DESCRIPTION OF THE PREFERRED EMBODIMENTS

The technical contents of the present invention will become apparent with the detailed description of preferred embodiments accompanied with the illustration of related drawings as follows.

Figure 1:
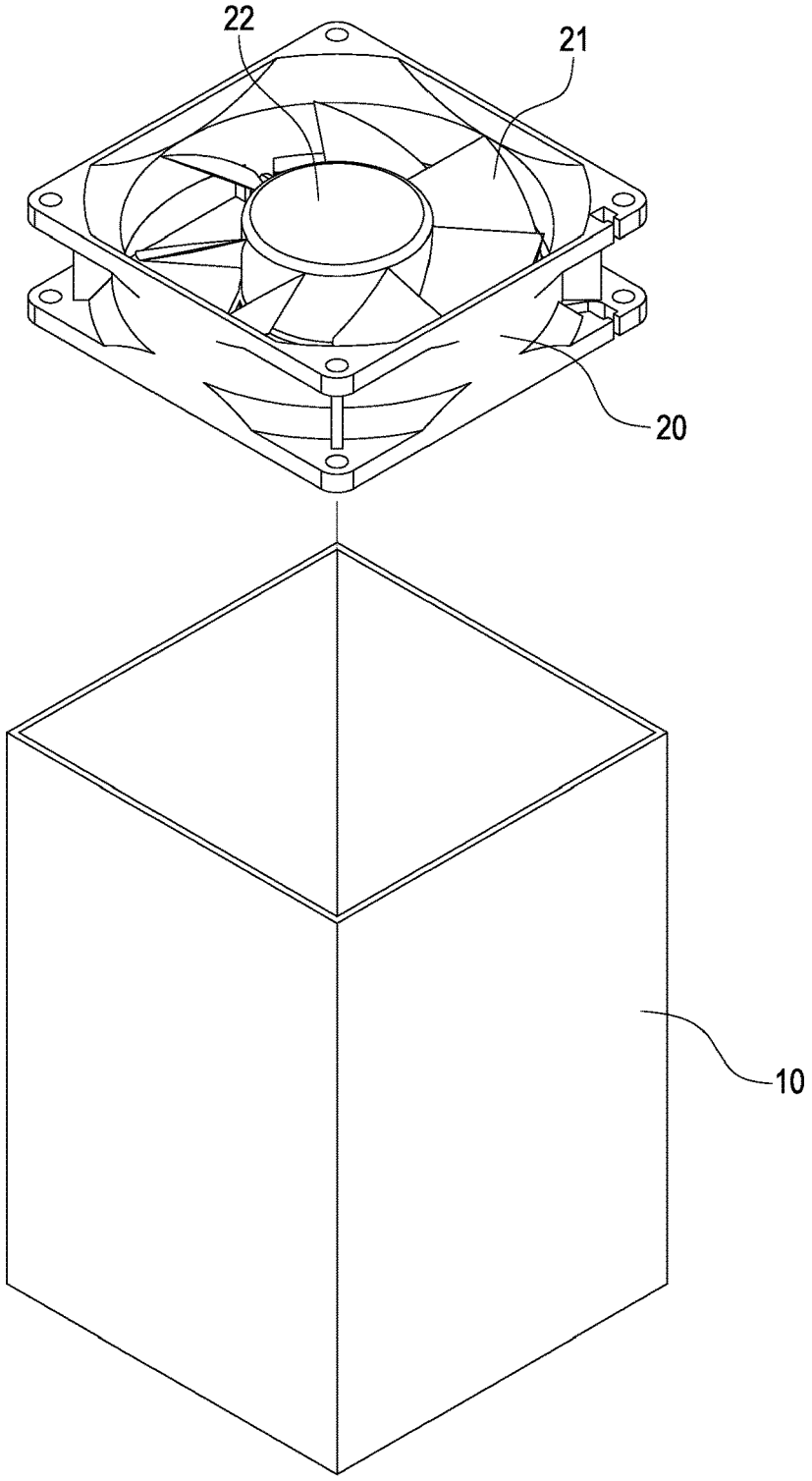
FIG.1 PRIOR ART
FIG. 1 is a schematic view of a conventional axial-flow fan.
Figure 2:
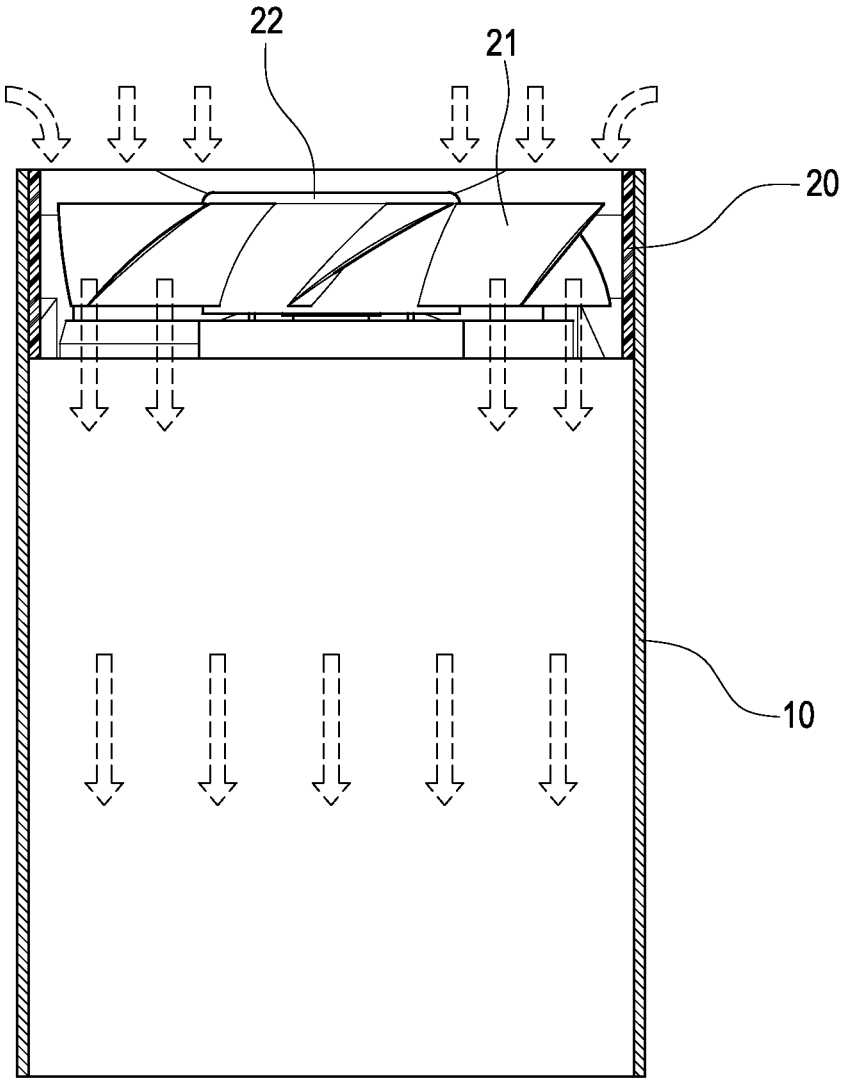
FIG.2 PRIOR ART
FIG. 2 is a schematic view of a working status of a conventional axial-flow fan.
Figure 3:
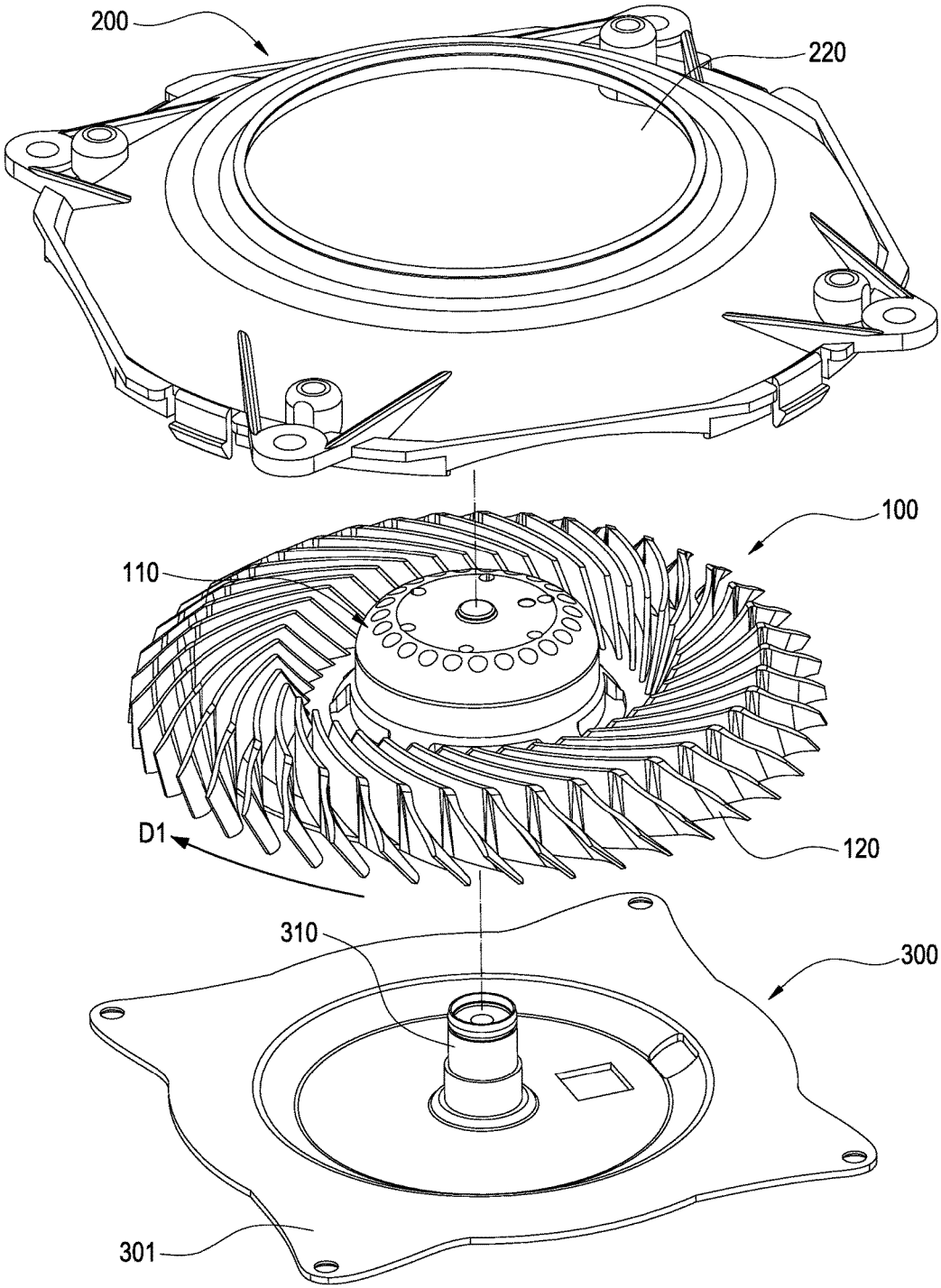
FIG. 3 is an exploded view of an external side of a centrifugal fan in accordance with a first preferred embodiment of the present invention.
Figure 4:
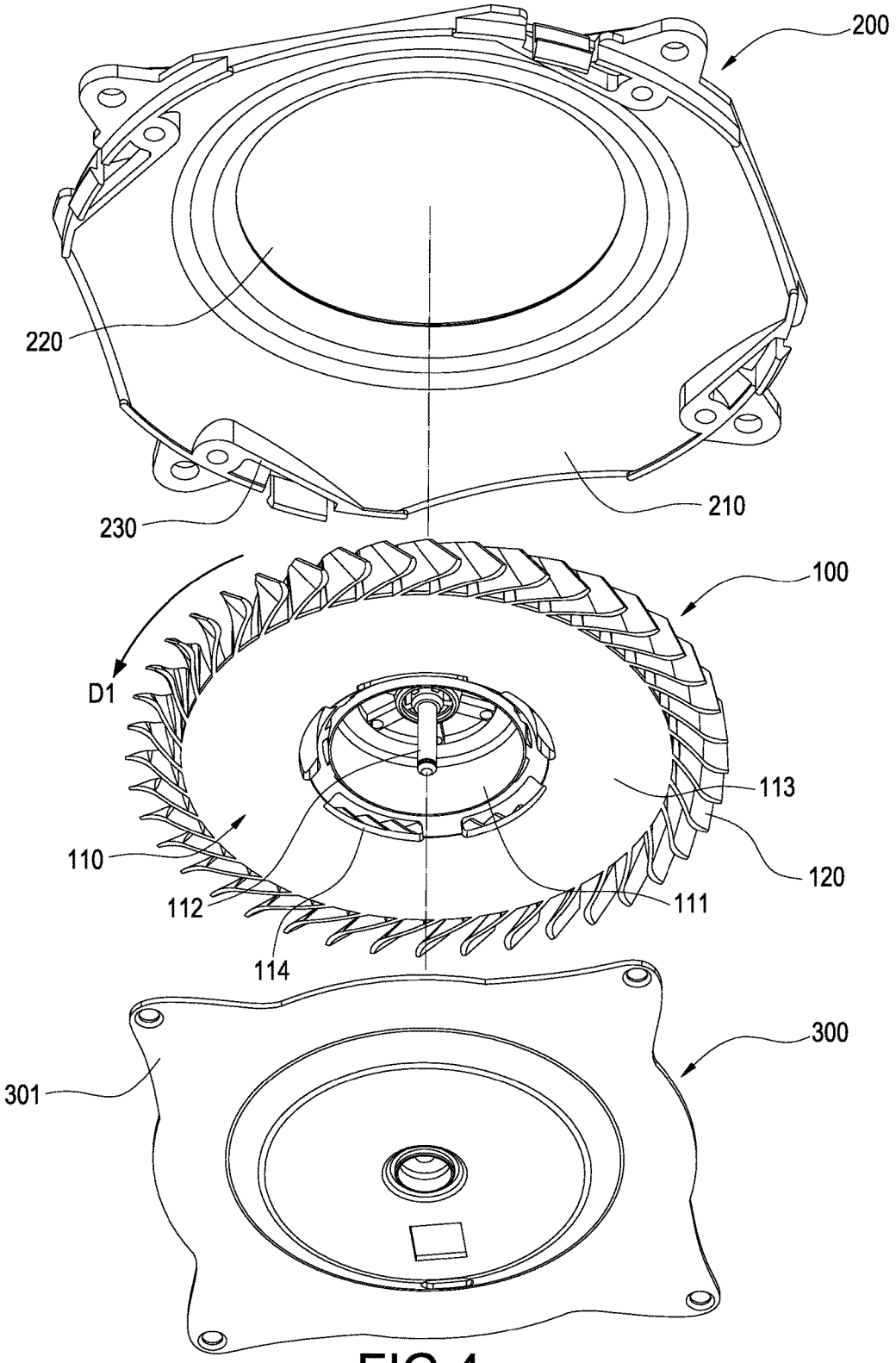
FIG. 4 is an exploded view of an internal side of a centrifugal fan in accordance with the first preferred embodiment of the present invention.

With reference to FIGS. 3 and 4 for a centrifugal fan with axial-flow wind in accordance with the first preferred embodiment of the present invention, the centrifugal fan with axial-flow wind comprises a centrifugal fan wheel 100, a cover shell 200 and a fixed base 300.

Figure 5:
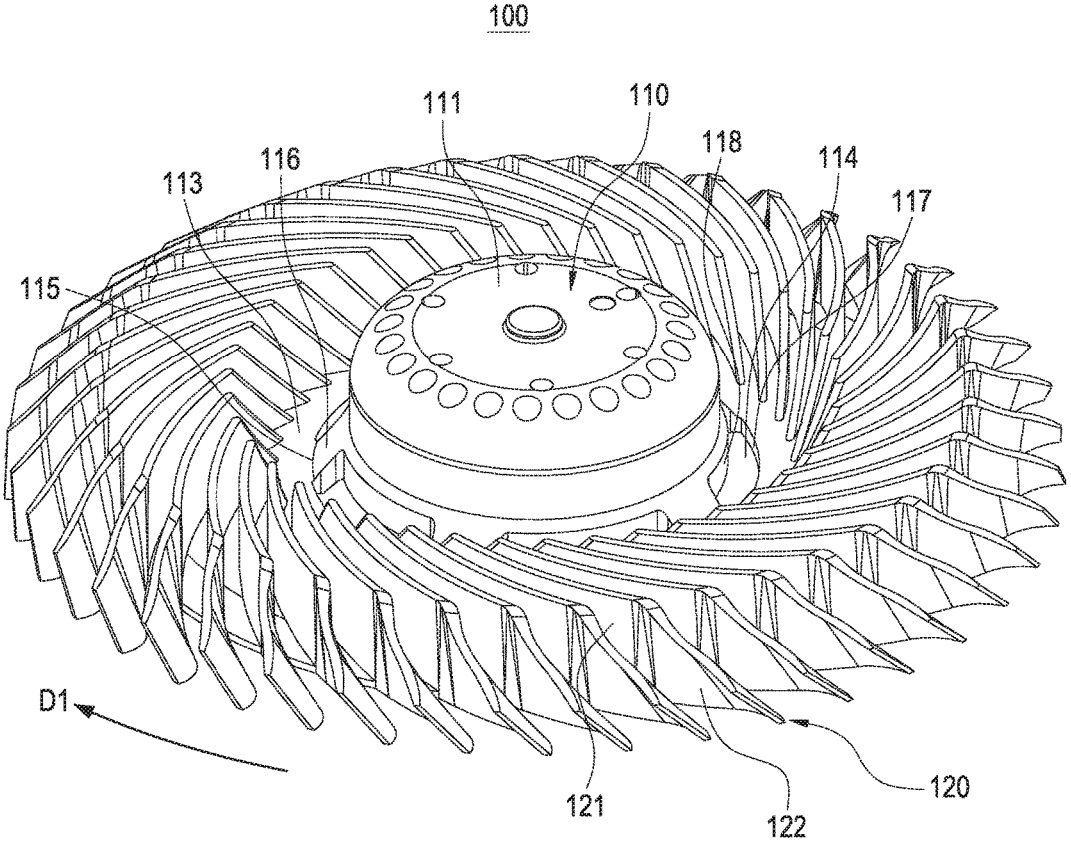
FIG. 5 is a schematic view of a centrifugal fan wheel in accordance with the first preferred embodiment of the present invention.

In FIGS. 3 to 5, the centrifugal fan wheel 100 comprises a rotating core structure 110 and a plurality of centrifugal vanes 120. The rotating core structure 110 comprises a fan hub 111 and a bottom plate 113, wherein the fan hub 111 is preferably a cylindrical casing (but the present invention is not limited to such arrangement only, and the fan hub 111 can also be a conical casing, too). Fan hub is connected to bottom plate 113 along a substantially circular connection line 115 by a plurality of legs 116. The fan hub and the bottom plate have corresponding sidewalls 117, 118 that define a plurality of broken holes 114. The broken holes 114 are separated from one another by the legs 116. The broken holes 114 are arranged around the fan hub along the substantially circular connection line 115. The fan hub 111 has an axle 112 mounted onto an internal side of the fan hub 111, wherein the axle 112 is preferably installed in an axial direction of the fan hub 111. The centrifugal fan wheel 100 is rotated along the axle 112 towards a forward direction D1. The bottom plate 113 is substantially in the shape of a circular plate and extended in an axial direction of the fan hub 111 from the fan hub 111 (or the axle 112), and a plurality of broken holes 114 is formed at and penetrated through the positions along the connection line of the fan hub 111 and the bottom plate 113 and arranged around the fan hub 111. The centrifugal vanes 120 around the axle 112 are arranged and disposed on the bottom plate 113, wherein each centrifugal vane 120 is preferably perpendicular to the bottom plate 113 and each centrifugal vane 120 includes a root portion 121 and a distal end 122, and the root portion 121 is substantially in a curved shape, and each centrifugal vane 120 is preferably installed on the bottom plate 113 by the root portion 121, and the distal end 122 is extended from the root portion 121 outwardly away from the axle 112, and the distal end 122 of each centrifugal vane 120 is preferably twisted or bent towards the forward direction D1 of the centrifugal fan wheel 100 and extended beyond the external periphery of the bottom plate 113.

The description above illustrates a preferred embodiment of installing the centrifugal fan wheel 100. However, the invention is not limited to such arrangement only, and the centrifugal fan wheel 100 can also comprise a fan hub 111 and a plurality of centrifugal vanes 120 only. The root portion 121 of each centrifugal vane 120 is coupled to the fan hub 111, and the distal end 122 of each centrifugal vane 120 is extended from the root portion 121 outwardly away from the axle 112.

Figure 6:
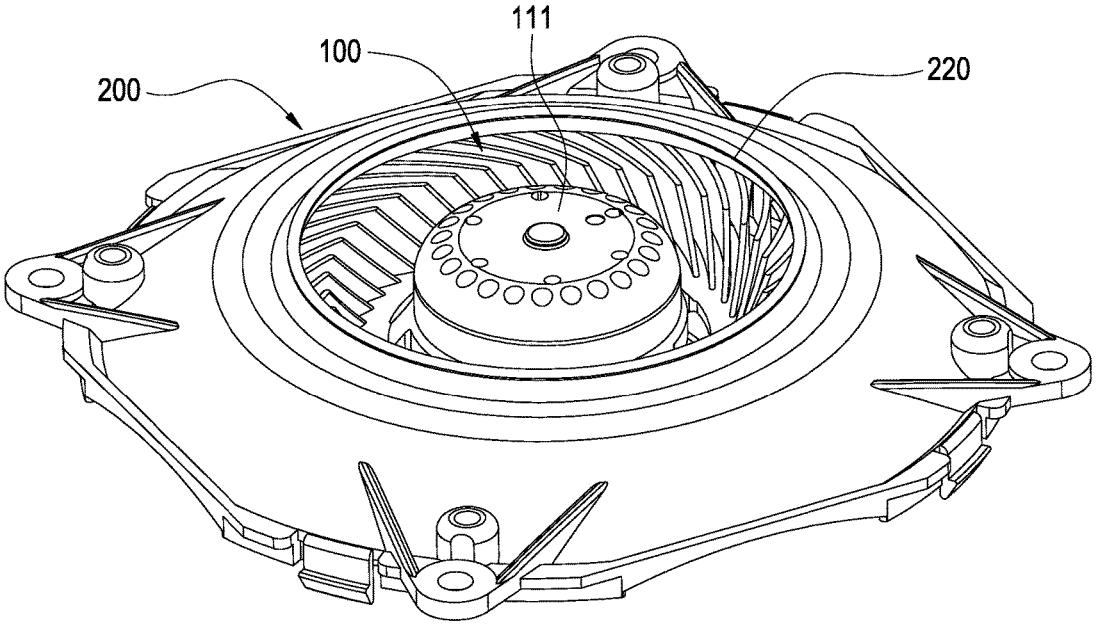
FIG. 6 is a schematic view of an external side of a centrifugal fan in accordance with the first preferred embodiment of the present invention.
Figure 7:
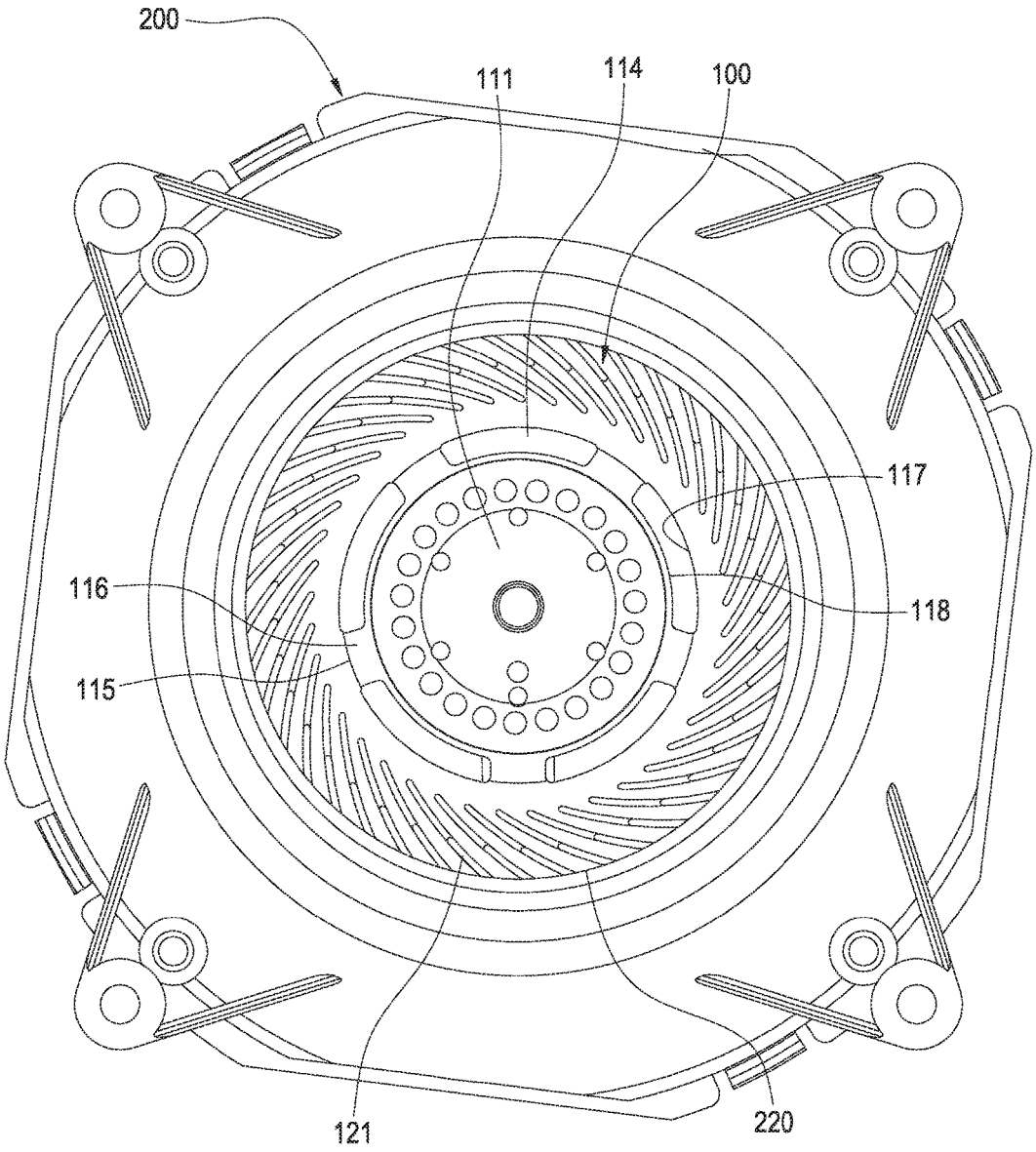
FIG. 7 is a front view of an external side of a centrifugal fan in accordance with the first preferred embodiment of the present invention.
Figure 8:
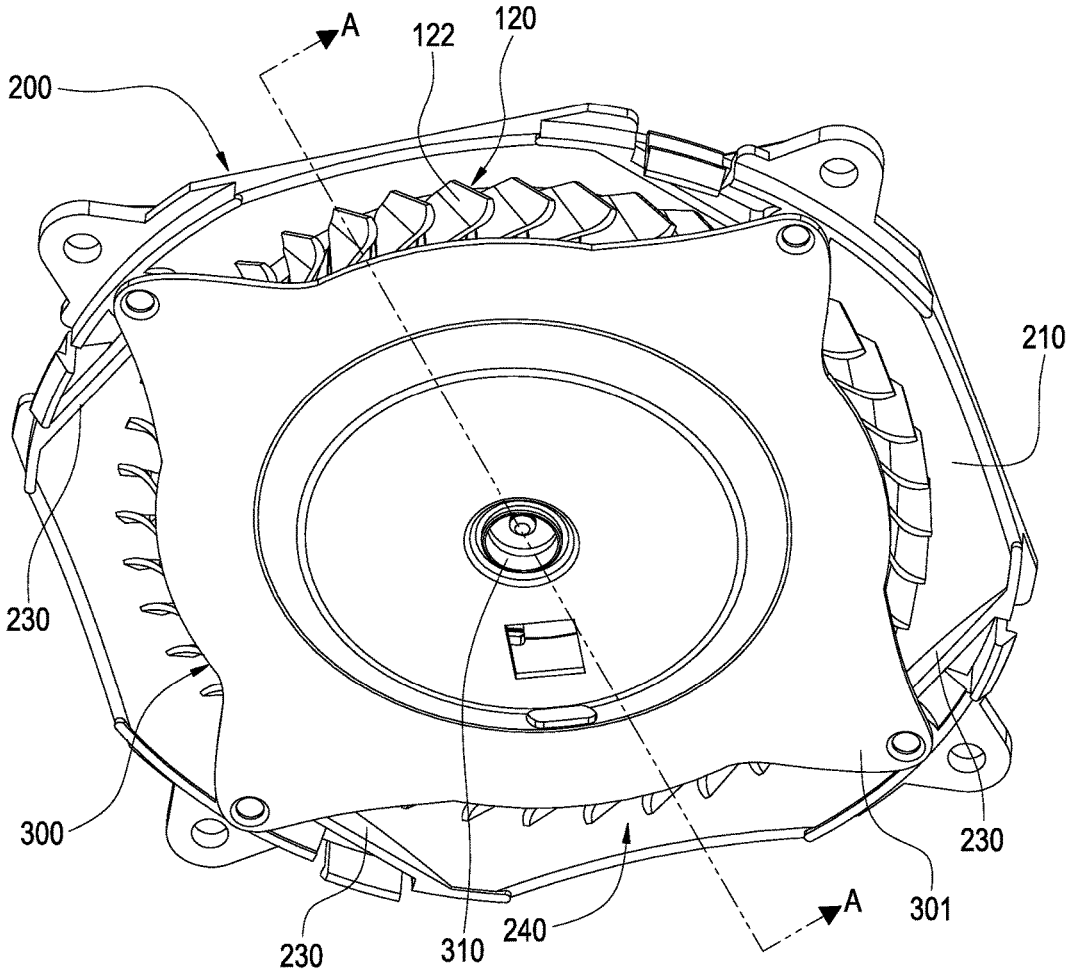
FIG. 8 is a front view of an external side of a centrifugal fan in accordance with the first preferred embodiment of the present invention.

With reference to FIGS. 6 to 8, the cover shell 200 is preferably in a conical shape and covered onto the exterior of the centrifugal fan wheel 100, and the cover shell 200 includes a circular wind guide surface 210 disposed on an internal side of the cover shell 200, and a wind inlet 220 formed at the top of the cover shell 200. The circular wind guide surface 210 is substantially a circular conical surface disposed around the axle 112. The fan hub 111 is aligned evenly with the wind inlet 220, and the root portion 121 of each centrifugal vane 120 is exposed from the wind inlet 220, and the circular wind guide surface 210 is covered onto the external side of the distal end 122 of the centrifugal vane 120. Preferably, the distal end 122 of the centrifugal vane 120 is tapered corresponding to the shape of the circular wind guide surface 210. The cover shell 200 includes a static blade 230 installed thereon, and inwardly protruded from the external periphery of the cover shell 200 and disposed on an internal side of the cover shell 200 for increasing the static pressure of the flow field in the cover shell 200.

Figure 9:
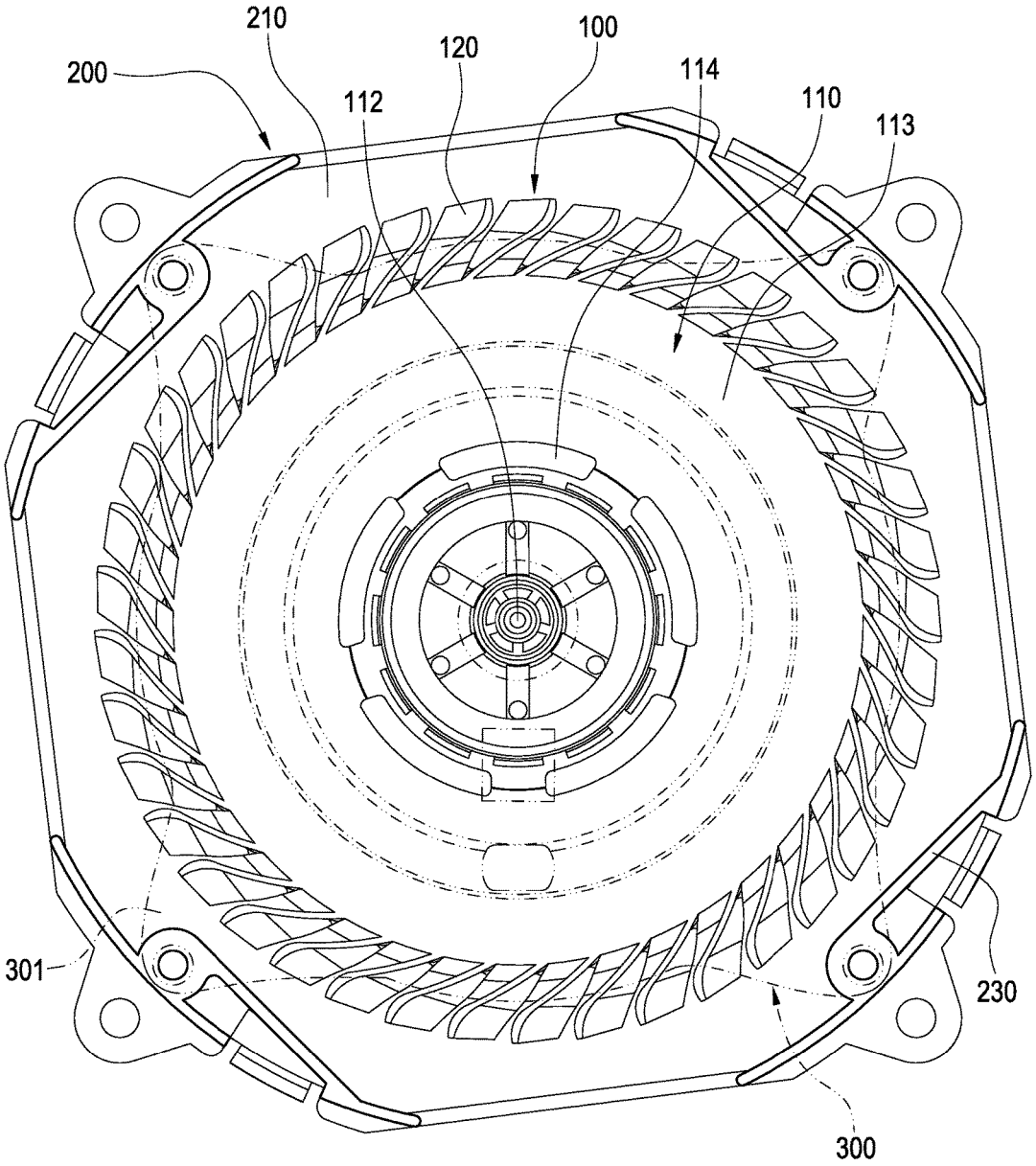
FIG. 9 is a front view of an internal side of a centrifugal fan in accordance with the first preferred embodiment of the present invention.

With reference to FIGS. 8 and 9, the fixed base 300 is preferably in the shape of a sheet and provided for fixing the axle 112 of the centrifugal fan wheel 100, and the fixed base 300 is coupled to the cover shell 200. A plurality of fixed portions 301 is extended from the external periphery of the fixed base 300 and coupled to the cover shell 200 (by a fixture including but not limited to a screw). The fixed base 300 includes a shaft sleeve 310 disposed perpendicularly thereon, and the centrifugal fan wheel 100 has a shaft sleeve 310 sheathed on the axle 112 to connect to the fixed base 300, and the centrifugal fan wheel 100 of the present invention is disposed between the cover shell 200 and the fixed base 300. Preferably, the area enclosed by the external periphery of the fixed base 300 is smaller than the area enclosed by the external periphery of the bottom of the cover shell 200, and a gap between the bottom of the cover shell 200 and the external periphery of the fixed base 300 constitutes a wind outlet 240, and the openings of the wind outlet 240 and the wind inlet are substantially parallel to each other.

Figure 10:
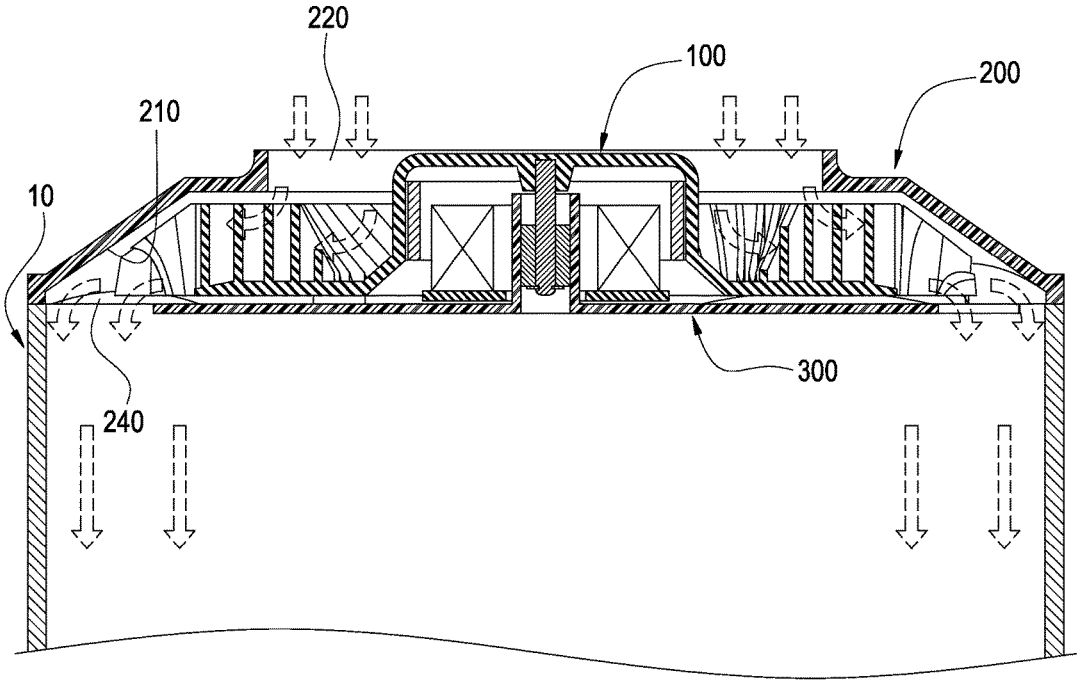
FIG. 10 is a cross-sectional view of Section A-A of a centrifugal fan in accordance with the first preferred embodiment of the present invention.

With reference to FIG. 10, the centrifugal fan of the present invention is installed in a housing 10. The centrifugal fan wheel 100 is rotated with respect to the axle 112 and in a forward direction D1 to suck air from the wind inlet 220. The air flows, along the root portion 121 of each centrifugal vane 120, from the centrifugal flow direction of the fan hub 111 and towards the distal end 122 of each centrifugal vane 120. With the bent distal end 122 of the centrifugal vanes 120 and the circular wind guide surface 210, the airflow in the centrifugal direction is switched to the axial-flow direction and air flows through the wind outlet 240 into the housing 10. However, the centrifugal fan of the present invention can only guide airflow from the circular wind guide surface 210 to change direction without the need of bending the distal end 122 of the centrifugal vane 120.

Figure 11:
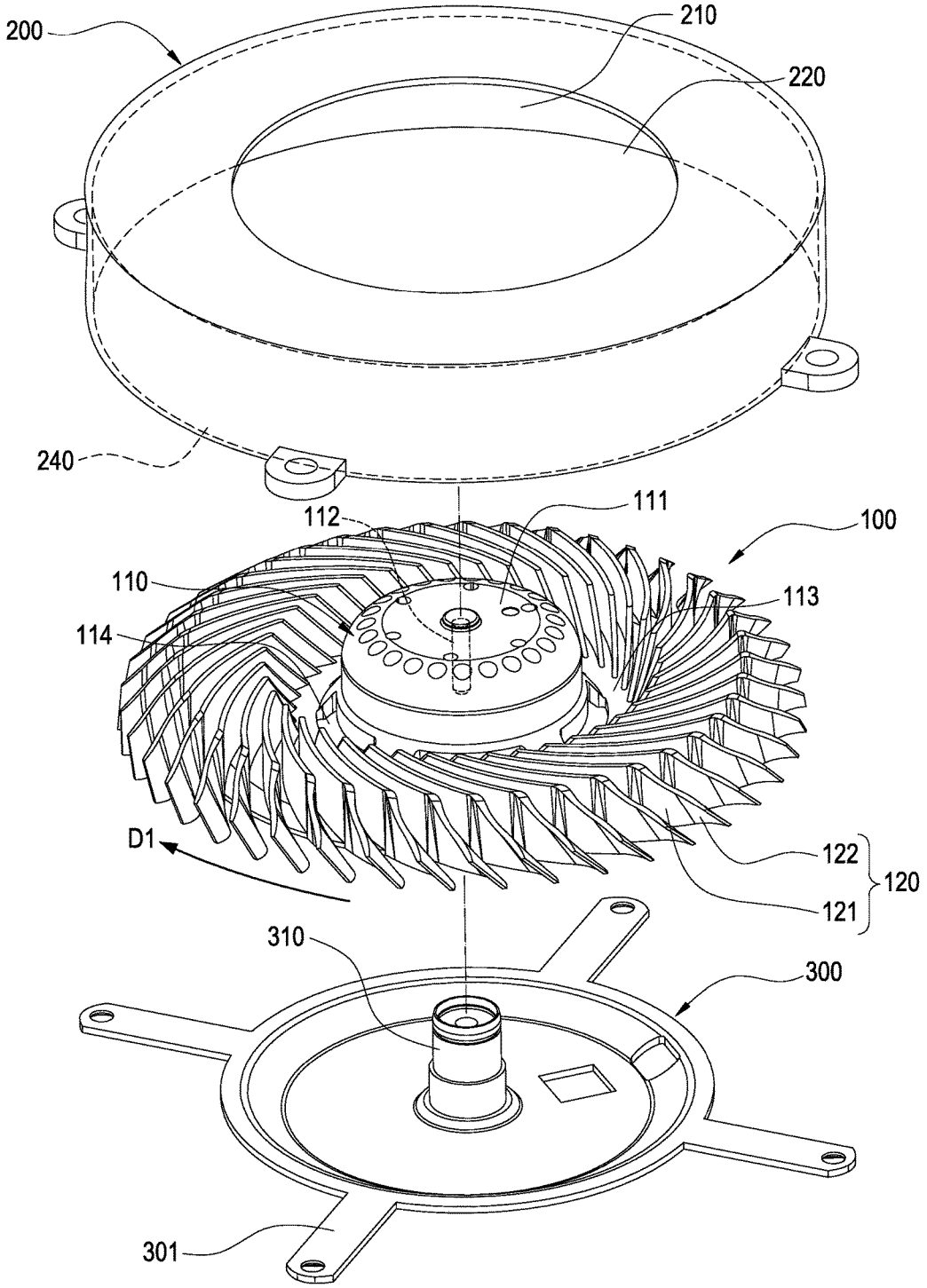
FIG. 11 is an exploded view of a centrifugal fan in accordance with a second preferred embodiment of the present invention.

With reference to FIG. 11 for a centrifugal fan with axial-flow wind in accordance with the second preferred embodiment of the present invention, the centrifugal fan with axial-flow wind comprises a centrifugal fan wheel 100, a cover shell 200 and a fixed base 300.

The centrifugal fan wheel 100 includes a rotating core structure 110 and a plurality of centrifugal vanes 120. The rotating core structure 110 includes a fan hub 111 and a bottom plate 113, wherein the fan hub 111 is preferably a cylindrical casing (but the present invention is not limited to such arrangement only. For example, the fan hub 111 can also be a conical casing). The fan hub 111 includes an axle 112 disposed on an internal side of the fan hub 111, and the axle 112 is preferably installed in an axial direction of the fan hub 111. The centrifugal fan wheel 100 is rotated with respect to the axle 112 in a forward direction D1. The bottom plate 113 is extended in a radial direction of the fan hub 111 (or the axle 112) from the fan hub 111, and a plurality of broken holes 114 is formed at positions along and penetrated through the connection line of the fan hub 111 and the bottom plate 113, and the broken holes 114 are arranged around the fan hub 111. The centrifugal vanes 120 are arranged around the axle 112 and installed on the bottom plate 113, and each centrifugal vane 120 is preferably perpendicularly to the bottom plate 113. Each centrifugal vane 120 has a root portion 121 and a distal end 122, wherein the root portion 121 is in a curved shape, and each centrifugal vane 120 is preferably disposed on the bottom plate 113 through the root portion 121, and the distal end 122 is extended from the root portion 121 outwardly away from the axle 112, and the distal end 122 of each centrifugal vane 120 is preferably twisted and bent towards the forward direction D1 of the centrifugal fan wheel 100 and extended beyond the external periphery of the bottom plate 113.

The description above illustrates a preferred embodiment of installing the centrifugal fan wheel 100. However, the invention is not limited to such arrangement only, and the centrifugal fan wheel 100 can also comprise a fan hub 111 and a plurality of centrifugal vanes 120 only. The root portion 121 of each centrifugal vane 120 is coupled to the fan hub 111, and the distal end 122 of each centrifugal vane 120 is extended from the root portion 121 outwardly away from the axle 112.

The cover shell 200 is substantially a cylindrical casing covered onto the exterior of the centrifugal fan wheel 100, and the cover shell 200 includes a circular wind guide surface 210 disposed on an internal side of the cover shell 200, and a wind inlet 220 formed at the top of the cover shell 200. The circular wind guide surface 210 is a circular plane and disposed around the axle 112, and the fan hub 111 is aligned evenly with the wind inlet 220, and the root portion 121 of each centrifugal vane 120 is exposed from the wind inlet 220, and the circular wind guide surface 210 is covered onto the external side of the distal end 122 of the centrifugal vane 120.

The fixed base 300 is fixed to the axle 112 of the centrifugal fan wheel 100, and coupled to the cover shell 200. The fixed base 300 has a plurality of fixed portions 301 in form of support legs and extended from the external periphery of the fixed base 300, and the fixed base 300 is coupled to the cover shell 200 through the fixed portions 301 (by a fixture including but not limited to a screw). The fixed base 300 includes a shaft sleeve 310 installed perpendicularly thereon, and the centrifugal fan wheel 100 has a shaft sleeve 310 sheathed on the axle 112 to connect the centrifugal fan wheel 100 to the fixed base 300, and the centrifugal fan wheel 100 of the present invention is disposed between the cover shell 200 and the fixed base 300. Preferably, the area enclosed by the external periphery of the fixed base 300 is smaller than the area enclosed by the external periphery of the bottom of the cover shell 200, and a gap between the bottom of the cover shell 200 and the external periphery of the fixed base 300 constitutes a wind outlet 240, and the openings of the wind outlet 240 and the wind inlet are substantially parallel to each other.

In the centrifugal fan of the present invention, the outlet channel is disposed at the external periphery of the centrifugal fan wheel 100, and the circular wind guide surface 210 and the bent distal end 122 of the centrifugal vane 120 guide the air near the external periphery of the centrifugal fan wheel 100 from a centrifugal direction to an axial-flow direction, so that the surrounding of the internal space of the housing 10 acts as a heat dissipation flow channel, and the space at the surrounding of the fixed base 300 is provided for installing electronic devices without hindering the flow channel. Compared with the conventional axial-flow fan 20, the centrifugal fan of the present invention provides a larger operating space in the housing 10 to fit a narrow installation space, and allow a smoother flow of the flow channel. In addition, the centrifugal fan also provides a greater wind pressure than that of the conventional axial-flow fan 20.

While the invention has been described by means of specific embodiments, numerous modifications and variations could be made thereto by those skilled in the art without departing from the scope and spirit of the invention set forth in the claims.

What is claimed is:

1. A centrifugal fan with axial-flow wind, comprising:

a centrifugal fan wheel having:

a rotating core structure comprising a fan hub, an axle and a bottom plate, the axle being mounted on an internal side of the fan hub and installed in an axial direction of the fan hub, the bottom plate being extended in a radial direction of the fan hub; and a plurality of centrifugal vanes arranged around the fan hub, each of the centrifugal vanes comprising a root portion installed on the bottom plate and a distal end extending from the root portion outwardly away from the axle and beyond an external periphery of the bottom plate;

a cover shell over an exterior of the centrifugal fan wheel, an internal side of the cover shell having a circular wind guide surface disposed around the rotating core structure and over the centrifugal vanes, and a wind inlet formed at a top of the cover shell; and a fixed base provided for installing the centrifugal fan wheel and being coupled to the cover shell, a gap formed between a bottom of the cover shell and an external periphery of the fixed base defining a wind outlet, wherein the distal end is exposed to the wind outlet so that air is fed in the axial direction from the wind inlet and exited from the axial direction and along an external periphery of the centrifugal fan wheel, the fan hub is connected to the bottom plate along a substantially circular connection line by a plurality of legs, the fan hub and the bottom plate comprise corresponding sidewalls that define a plurality of broken holes, the broken holes of the plurality of broken holes are separated from one another by the plurality of legs, and the broken holes of the plurality of broken holes are arranged around the fan hub along the substantially circular connection line, and the distal end is twisted toward a forward direction of the centrifugal fan wheel so as to guide wind from a centrifugal direction to the axial direction.

2. The centrifugal fan according to claim 1, wherein the cover shell is substantially conical in shape.

3. The centrifugal fan according to claim 1, wherein the root portion is substantially curved in shape.

4. The centrifugal fan according to claim 1, wherein the centrifugal fan wheel is between the cover shell and the fixed base, and an area enclosed by the external periphery of the fixed base is smaller than an area enclosed by an external periphery of the bottom of the cover shell.

5. A centrifugal fan with axial-flow wind, comprising:

a centrifugal fan wheel having a fan hub, a bottom plate, and a plurality of centrifugal vanes arranged around the fan hub, the bottom plate being extended in a radial direction of the fan hub, each of the centrifugal vanes comprising a root portion and a distal end, the root portion of each of the centrifugal vanes being connected to the bottom plate, and the distal end being extended from the root portion outwardly away from the fan hub;

a cover shell, substantially conical in shape, over an exterior of the centrifugal fan wheel, an internal side of the cover shell having a circular wind guide surface disposed around the fan hub and over each of the centrifugal vanes, and the cover shell having a wind inlet formed at a top of the cover shell; and a fixed base provided for installing the centrifugal fan wheel and coupled to the cover shell, a gap formed between a bottom of the cover shell and an external periphery of the fixed base defining a wind outlet, wherein the fan hub is connected to the bottom plate along a substantially circular connection line by a plurality of legs, the fan hub and the bottom plate comprise corresponding sidewalls that define a plurality of broken holes, the broken holes of the plurality of broken holes are separated from one another by the plurality of legs, and the broken holes of the plurality of broken holes are arranged around the fan hub along the substantially circular connection line, the distal end is exposed to the wind outlet, the distal end is extended beyond the bottom plate and twisted toward a forward direction of the centrifugal fan wheel, and an airflow at an external periphery of the centrifugal fan wheel is guided by the twisted distal end to flow from a centrifugal direction to an axial-flow direction.

6. The centrifugal fan according to claim 5, wherein the wind inlet is substantially parallel to the wind outlet.

7. The centrifugal fan according to claim 5, wherein a plurality of fixed portions are extended from the external periphery of the fixed base so that the fixed base is connected to the cover shell via the fixed portions.

8. The centrifugal fan according to claim 5, wherein the cover shell further includes a static blade inwardly protruded from an external periphery of the cover shell and disposed on an internal side of the cover shell.

* * * * *